US008739346B1

(12) United States Patent
Kang et al.

(10) Patent No.: US 8,739,346 B1
(45) Date of Patent: Jun. 3, 2014

(54) ERASER ASSEMBLY

(71) Applicant: ACCO Brands Corporation, Lincolnshire, IL (US)

(72) Inventors: Seesong Kang, Northbrook, IL (US); Jonathen Shearer, Skokie, IL (US); Randeep Dhillion, Grayslake, IL (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 13/788,991

(22) Filed: Mar. 7, 2013

(51) Int. Cl.
*A47L 13/10* (2006.01)
*A47L 13/16* (2006.01)

(52) U.S. Cl.
USPC ..... 15/118; 15/105.51; 15/209.1

(58) Field of Classification Search
USPC ..... 15/118, 209.1, 223, 224, 244.1, 425, 15/426, 105.51
See application file for complete search history.

(56) References Cited

U.S. PATENT DOCUMENTS 3,257,679 A * 6/1966 Duskins ..... 15/118
3,262,145 A * 7/1966 Carlson ..... 15/244.1
4,319,594 A * 3/1982 Parker ..... 132/120
5,765,407 A * 6/1998 Choo et al. ..... 68/214

OTHER PUBLICATIONS

ChenilleKraft 12-In-1 Whiteboard Eraser, http://www.officedepot.com/a/products/722950/ChenilleKraft-12-In-1-Whiteboard-Eraser/, available Feb. 22, 2013 (2 pages).

* cited by examiner

*Primary Examiner* — Randall Chin
(74) *Attorney, Agent, or Firm* — Michael Best & Friedrich LLP

(57) ABSTRACT

An eraser assembly includes a first support member and a second support member. The first support member has a first eraser pad with a first surface area. The second support member is coupled to the first support member and has a second eraser pad with a second surface area that is different than the first surface area. The second support member is removable from the first support member such that the second eraser pad is usable independently of the first eraser pad.

20 Claims, 4 Drawing Sheets

ERASER ASSEMBLY

BACKGROUND

The present invention relates to erasers for use with dry-erase boards, chalkboards, and the like.

Erasers are commonly used to remove dry-eraser marker or chalk from dry-erase boards and chalkboards, respectively. Larger erasers are desirable to remove large sections of marker or chalk at a time. Smaller erasers are desirable to remove smaller sections of marker or chalk in a more controlled manner. Individual erasers, however, are typically only one size.

SUMMARY

In one embodiment, the invention provides an eraser assembly including a first support member having a first eraser pad with a first surface area. The eraser assembly also includes a second support member coupled to the first support member and having a second eraser pad with a second surface area that is different than the first surface area. The second support member is removable from the first support member such that the second eraser pad is usable independently of the first eraser pad.

In another embodiment, the invention provides an eraser assembly including a first support member having a first eraser pad and a recess. The eraser assembly also includes a second support member having a second eraser pad. A portion of the second support member is removably received within the recess of the first support member to couple the second support member to the first support member.

In yet another embodiment, the invention provides an eraser assembly including a support member having a first eraser pad and an outer perimeter. The eraser assembly also includes a handle removably coupled to and extending away from the support member. The handle includes a second eraser pad. The handle is positioned within the outer perimeter of the support member when coupled to the support member.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-4 illustrate an eraser assembly 10. The eraser assembly 10 is usable to clean a display board, such as a whiteboard or a chalkboard. For example, in some embodiments, the eraser assembly 10 is configured to wipe dry-erase marker off of whiteboards. In other embodiments, the eraser assembly 10 is configured to wipe chalk off of chalkboards.

Figure 1:
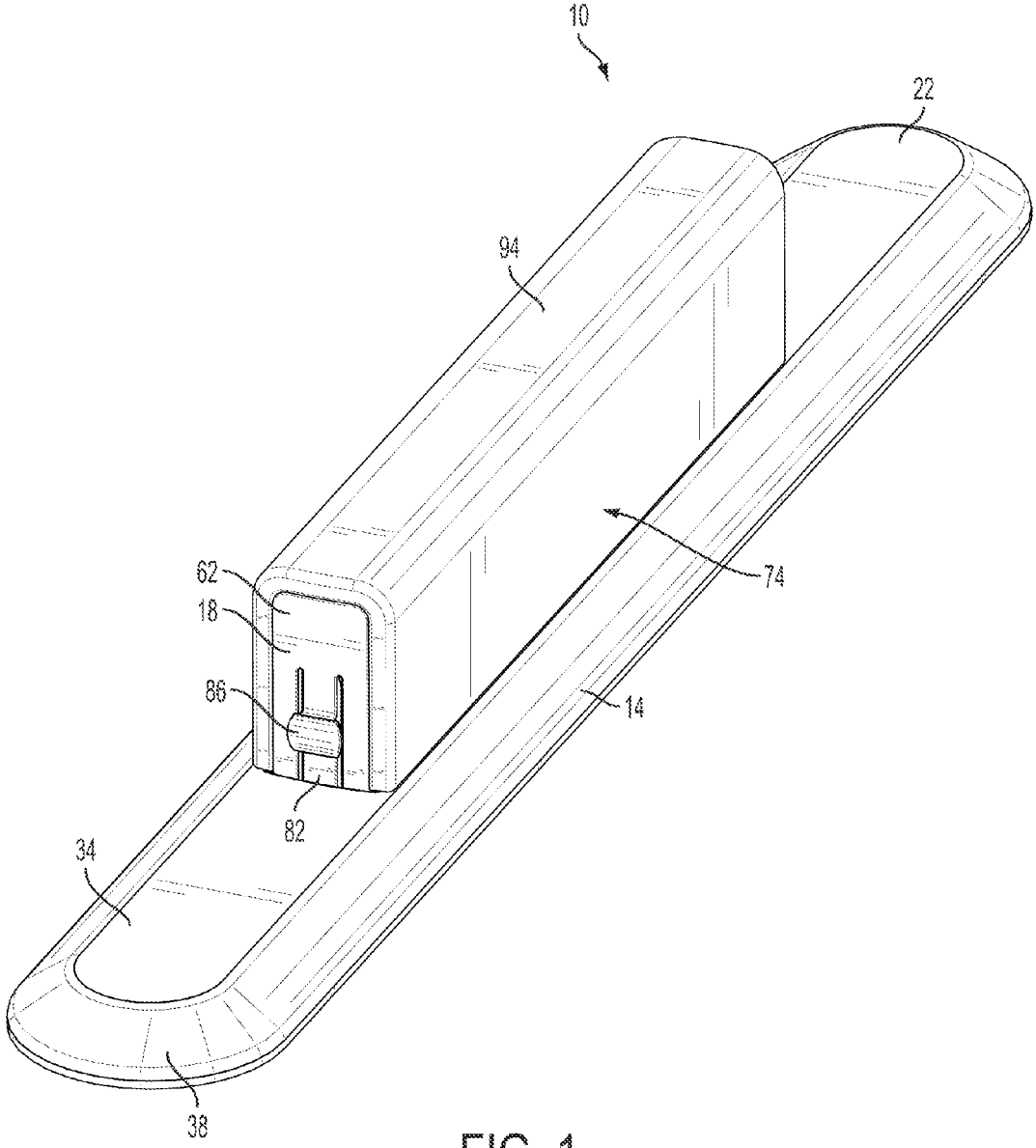
FIG. 1 is a perspective view of an eraser assembly embodying the invention.
Figure 2:
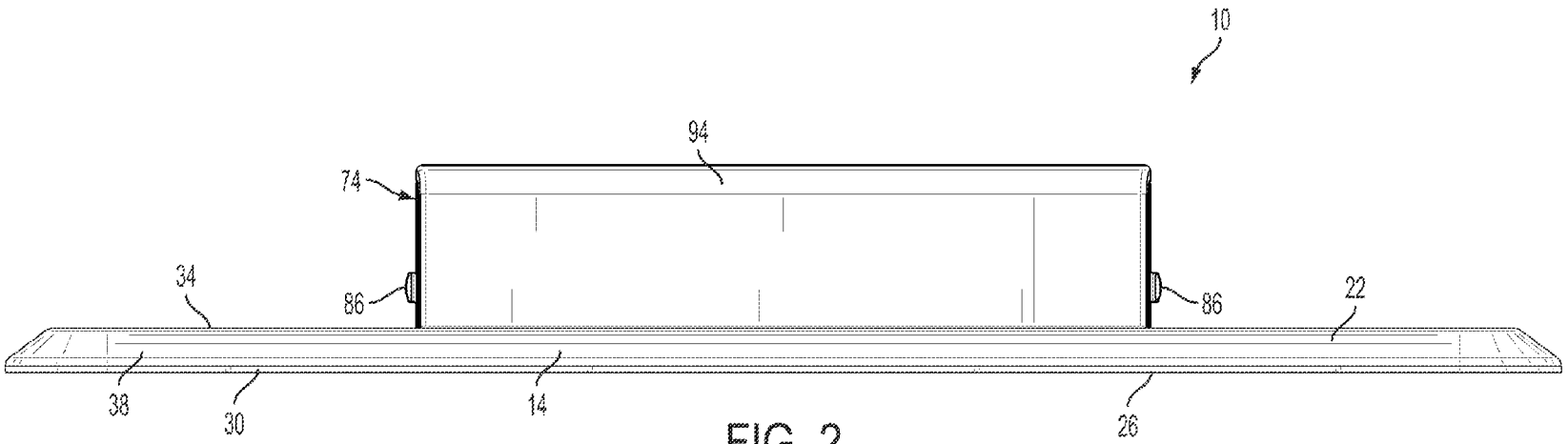
FIG. 2 is a side view of the eraser assembly.
Figure 3:
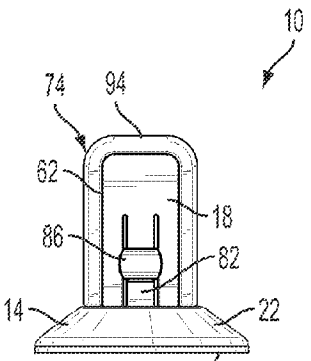
FIG. 3 is an end view of the eraser assembly.
Figure 5:
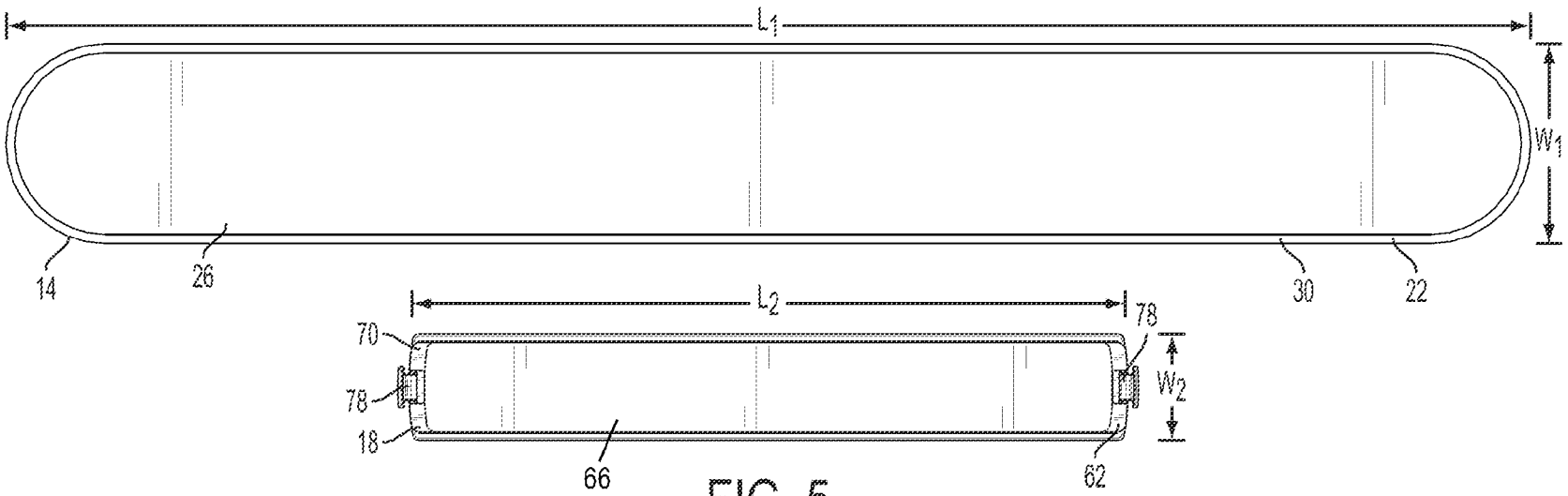
FIG. 5 is a bottom view of a first support member and a second support member of the eraser assembly.

The illustrated eraser assembly 10 includes a first support member 14 and a second support member 18. The support members 14, 18 are releasably coupled together. When connected (as shown in FIGS. 1-3), the first and second support members 14, 18 are usable together as a single, relatively large eraser. When separated (as shown in FIG. 5), the second support member 18 is usable independently of the first support member 14 as a relatively small eraser. The relatively large eraser defined by both of the support members 14, 18 together is usable to quickly clean large areas of a display board. The relatively small eraser defined by the second support member 18 alone is usable to clean small areas of a display board in a more precise manner.

Figure 4:
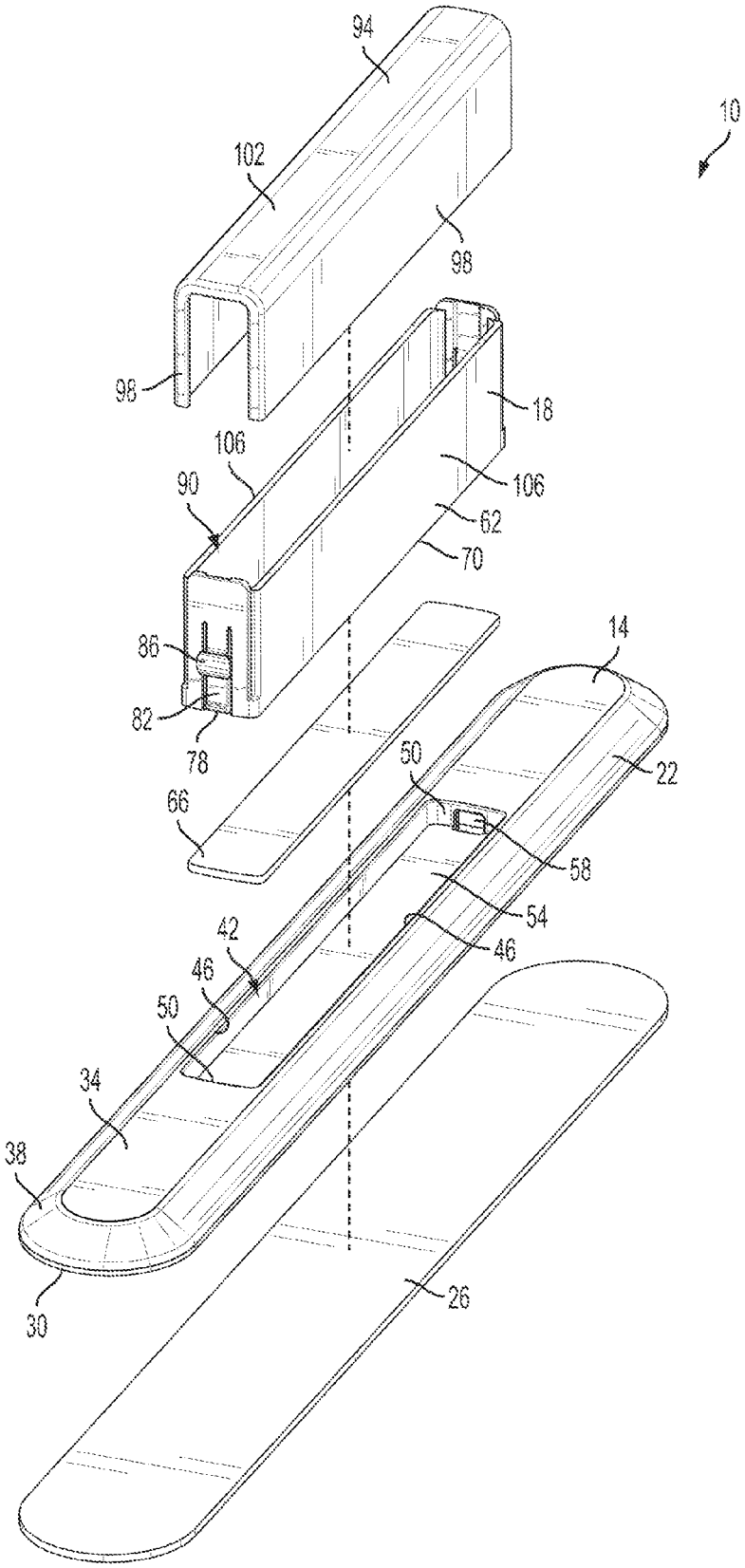
FIG. 4 is an exploded perspective view of the eraser assembly.

As shown in FIG. 4, the illustrated first support member 14 includes an elongated body 22 and a first eraser pad 26. The elongated body 22 has a first generally planar surface 30, a second generally planar surface 34, and a tapered surface 38 formed around the edge of the second generally planar surface 34. The first and second generally planar surfaces 30, 34 are parallel to each other. The tapered surface 38 forms a smooth transition between the generally planar surfaces 30, 34 and defines an outer perimeter of the first support member 14.

The first eraser pad 26 is coupled to the first generally planar surface 30. The eraser pad 26 is composed of a material suitable for wiping dry-erase marker or chalk off of a display board, as required for a particular application. As shown in FIG. 5, the illustrated eraser pad 26 is shaped and sized to cover almost the entire surface area of the first generally planar surface 30. The eraser pad 26 is only slightly smaller than the first generally planar surface 30 such that the elongated body 22 forms a small border around the eraser pad 26. In some embodiments, the eraser pad 26 may be removable from the elongated body 22 for cleaning and/or replacement.

Referring back to FIG. 4, the first support member 14 also includes a recess 42 formed in the second generally planar surface 34. The recess 42 is defined by two sidewalls 46, two end walls 50, and an inner surface 54 of the support member 14. The illustrated recess 42 is positioned in a center of the second generally planar surface 34 within the outer perimeter of the first support member 14 defined by the tapered surface 38. The recess 42 is shaped and sized to receive a portion of the second support member 18. Slots 58 (only one of which is shown in FIG. 4) are formed in the end walls 50 to facilitate securing the second support member 18 within the recess 42.

The illustrated second support member 18 includes an elongated body 62 and a second eraser pad 66. The elongated body 62 of the second support member 18 is smaller (e.g., shorter and less wide) than the elongated body 22 of the first support member 14 such that the second support member 18 fits within the outer perimeter of the first support member 14. The elongated body 62 of the second support member 18, however, is taller than the elongated body 22 of the first support member 14. The elongated body 62 has a generally planar surface 70 that faces the first support member 14 when the support members 14, 18 are coupled together.

The second eraser pad 66 is coupled to the generally planar surface 70. Similar to the first eraser pad 26 discussed above, the second eraser pad 66 is composed of a material suitable for wiping dry-erase marker or chalk off of a display board. As shown in FIG. 5, the illustrated eraser pad 66 is shaped and sized to cover almost the entire surface area of the generally planar surface 70. The eraser pad 66 is only slightly smaller than the generally planar surface 70 such that the elongated body 62 forms a small border around the eraser pad 66. In some embodiments, the eraser pad 66 may be removable from the elongated body 62 for cleaning and/or replacement.

As shown in FIG. 5, the first eraser pad 26 has a surface area that is generally defined by a length $L_1$ and a width $W_1$ of the first support member 14. Similarly, the second eraser pad 66 has a surface area that is generally defined by a length $L_2$ and a width $W_2$ of the second support member 18. As discussed above, the length $L_2$ and the width $W_2$ of the second support member 18 are smaller than the length $L_1$ and the width $W_1$ of the first support member 14. As such, the surface area of the first eraser pad 26 is greater than the surface area of the second eraser pad 66. In the illustrated embodiment, the first support member 14 is about twice as long and about twice as wide as the second support member 18 such that the surface area of the first eraser pad 26 is about four times greater than the surface area of the second eraser pad 66. In other embodiments, the surface area of the first eraser pad 26 may be at least twice as large as the surface area of the second eraser pad 66.

As shown in FIGS. 1-3, the second support member 18 is selectively received in the recess 42 of the first support member 14 to couple the second support member 18 to the first support member 14. When received in the recess 42, the second support member 18 is positioned within the outer perimeter of the first support member 14. In addition, a portion of the second support member 18 extends out of the recess 42 and away from the first support member 14 to form a grip 74. That is, the second support member 18 is a handle that may be grasped by a user to hold and manipulate the eraser assembly 10. In the illustrated embodiment, a majority of the second support member 18 extends out of the recess 42 due to the significantly larger height of the second support member 18 compared to the first support member 14. In other embodiments, a relatively larger or smaller portion of the second support member 18 may extend out of the recess 42.

When the second support member 18 is received in the recess 42, the first support member 14 covers the second eraser pad 66. In particular, the second eraser pad 66 is enclosed between the inner surface 54 of the first support member 14 and the generally planar surface 70 of the second support member 18. In this condition, only the first eraser pad 26 is exposed and visible when the support members 14, 18 are coupled together. In other embodiments, the recess 42 may extend through both of the generally planar surfaces 30, 34 of the first support member 14. In such embodiments, the second eraser pad 66 may be exposed through the first generally planar surface 30 when the support members 14, 18 are coupled together, or may be covered by the first eraser pad 26.

As shown in FIG. 4, the second support member 18 also includes two tabs 78 (both of which are shown in FIG. 5) to selectively secure the second support member 18 within the recess 42. The tabs 78 are configured to fit within the slots 58 formed in the recess 42 to engage the first support member 14. The illustrated tabs 78 are supported on cantilevered portions 82 of the second support member 18. The cantilevered portions 82 allow the tabs 78 to move or deflect relative to the elongated body 62. Each cantilevered portion 82 includes a contoured projection 86 to facilitate moving the tabs 78 relative to the elongated body 62. Actuating (e.g., depressing) the projections 86 deflects the cantilevered portions 82 inwardly, sliding the tabs 78 out of the slots 58 to disengage the tabs 78 from the first support member 14. When disengaged, the second support member 18 can be lifted or pulled out of the recess 42 to separate the support members 14, 18. In other embodiments, the first support member 14 may include the tabs 78, and the second support member 18 may define the slots 58. In further embodiments, other suitable mechanisms may be employed to temporarily and releasably secure the second support member 18 to the first support member 14.

The second support member 18 defines a storage area 90 (FIG. 4). The storage area 90 is formed within the elongated body 62 such that the support member 18 is generally hollow. The storage area 90 is configured to store replacement eraser pads or other suitable items (e.g., wipes, spray bottles, markers, chalk, etc.) for use with the eraser assembly 10.

The eraser assembly 10 also includes a cover member 94 removably coupled to the second support member 18. The cover member 94 provides selective access to the storage area 90. The illustrated cover member 94 has a generally U-shaped cross-section defined by two parallel sidewalls 98 and a connecting wall 102. The sidewalls 98 fit over outer surfaces 106 of the elongated body 62, while the connecting wall 102 extends over an open end of the elongated body 62 to cover the storage area 90. In the illustrated embodiment, the cover member 94 is slidable onto the elongated body 62 to cover and enclose the storage area 90. When the cover member 94 is slid off of the elongated body 62, the cover member 94 is completely removed from the second support member 18 to provide access to the storage area 90. In other embodiments, the cover member 94 may be hingedly coupled, or otherwise secured, to the elongated body 62 such that the cover member 94 remains connected to the second support member 18 even when the cover member 94 is opened to provide access to the storage area 90.

In operation, the eraser assembly 10 is usable as a relatively large eraser when the first and second support members 14, 18 are coupled together, as shown in FIGS. 1-3. When used as the relatively large eraser, the second support member 18 is received in the recess 42 of the first support member 14 such that the tabs 78 engage the slots 58 (FIG. 4). In this position, the second support member 18 extends away from the first support member 14 and, with the cover member 94, is the handle of the eraser assembly 10. The relatively large eraser (i.e., the first and second support members 14, 18 together) is usable to clean a display board with the first eraser pad 26.

Alternatively, the eraser assembly 10 is usable as a relatively small eraser when the second support member 18 is disconnected from the first support member 14, as shown in FIG. 5. To separate the support members 14, 18, the cantilevered portions 82 (FIG. 4) are deflected inwardly by depressing the contoured projections 86 to slide the tabs 78 out of the slots 58 (FIG. 4). The second support member 18 is then pulled out of the recess 42 in the first support member 14. Once the support members 14, 18 are separated, the relatively small eraser (i.e., the second support member 18 alone) is usable to clean a display board with the second eraser pad 66. When finished, the second support member 18 is insertable back into the recess 42 in the first support member 14 such that the tabs 78 slide into the slots 58 and engage the first support member 14 to reform the relatively large eraser.

Although the invention has been described with reference to certain preferred embodiments, variations and modifications exist within the scope and spirit of one or more independent aspects of the invention.

Various features and advantages of the invention are set forth in the following claims.

What is claimed is:

1. An eraser assembly comprising:

a first support member including a first eraser pad having a first surface area; and a second support member coupled to the first support member and including a second eraser pad having a second surface area that is different than the first surface area, the second support member being removable from the first support member such that the second eraser pad is usable independently of the first eraser pad;

wherein the first support member and the second support member are usable together as a single eraser when the second support member is coupled to the first support member, wherein the second eraser pad is covered by the first support member when the first and second support members are coupled together as the single eraser, and wherein the first surface area of the first eraser pad is greater than the second surface area of the second eraser pad.

2. The eraser assembly of claim 1, wherein the second support member extends away from the first support member to form a grip of the single eraser.

3. The eraser assembly of claim 1, wherein the first support member defines a recess, and wherein a portion of the second support member is received in the recess to couple the second support member to the first support member.

4. An eraser assembly comprising:

a first support member including a first eraser pad having a first surface area; and a second support member coupled to the first support member and including a second eraser pad having a second surface area that is different than the first surface area, the second support member being removable from the first support member such that the second eraser pad is usable independently of the first eraser pad;

wherein one of the first support member and the second support member includes a tab, and wherein the tab engages the other of the first support member and the second support member to releasably couple the second support member to the first support member.

5. An eraser assembly comprising:

a first support member including a first eraser pad and a recess; and a second support member including a second eraser pad, a portion of the second support member being removably received within the recess of the first support member to couple the second support member to the first support member;

wherein one of the first support member and the second support member includes a tab, and wherein the tab engages the other of the first support member and the second support member to releasably couple the second support member to the first support member.

6. The eraser assembly of claim 5, wherein the first support member covers the second eraser pad when the portion of the second support member is received within the recess.

7. The eraser assembly of claim 5, wherein another portion of the second support member extends away from the first support member to form a grip.

8. The eraser assembly of claim 5, wherein the first support member includes a first generally planar surface and a second generally planar surface, wherein the first eraser pad is coupled to the first generally planar surface, and wherein the recess is formed in the second generally planar surface.

9. The eraser assembly of claim 5, wherein the tab is supported on a cantilevered portion of the second support member.

10. The eraser assembly of claim 5, wherein the second support member defines a storage area.

11. The eraser assembly of claim 10, further comprising a cover member removably coupled to the second support member, wherein the cover member provides selective access to the storage area.

12. An eraser assembly comprising:

a support member including a first eraser pad and having an outer perimeter; and a handle removably coupled to and extending away from the support member, the handle including a second eraser pad, the handle being positioned within the outer perimeter of the support member when coupled to the support member;

wherein the support member has a length and a width, wherein the handle has a length and a width, and wherein the length and the width of the handle are smaller than the length and the width of the support member;

wherein the first eraser pad has a first surface area, wherein the second eraser pad has a second surface area, and wherein the first surface area is greater than the second surface area.

13. The eraser assembly of claim 12, wherein the handle is removable from the support member such that the second eraser pad is usable independently of the first eraser pad.

14. The eraser assembly of claim 13, wherein the support member covers the second eraser pad when the handle is coupled to the support member.

15. An eraser assembly comprising:

a first support member including a first eraser pad having a first footprint area; and a second support member coupled to the first support member and including a second eraser pad having a second footprint area that is different than the first footprint area, the second support member being removable from the first support member such that the second eraser pad is usable independently of the first eraser pad.

16. The eraser assembly of claim 15, wherein the first eraser pad and the second eraser pad are generally rectangular.

17. The eraser assembly of claim 15, wherein the first support member and the second support member are usable together as a single eraser when the second support member is coupled to the first support member.

18. The eraser assembly of claim 17, wherein the second eraser pad is covered by the first support member when the first and second support members are coupled together as the single eraser.

19. The eraser assembly of claim 18, wherein the first footprint area of the first eraser pad is greater than the second footprint area of the second eraser pad.

20. The eraser assembly of claim 15, wherein one of the first support member and the second support member includes a tab, and wherein the tab engages the other of the first support member and the second support member to releasably couple the second support member to the first support member.

* * * * *